US008628291B2

(12) United States Patent
Hiller

(10) Patent No.: US 8,628,291 B2
(45) Date of Patent: Jan. 14, 2014

(54) GAS TURBINE COMPRESSOR

(75) Inventor: Sven-J. Hiller, Roehrmoos (DE)

(73) Assignee: MTU Aero Engines GmbH, Munich (DE)

( * ) Notice: Subject to any disclaimer, the term of this patent is extended or adjusted under 35 U.S.C. 154(b) by 408 days.

(21) Appl. No.: 12/935,850

(22) PCT Filed: Apr. 2, 2009

(86) PCT No.: PCT/DE2009/000461
§ 371 (c)(1),
(2), (4) Date: Dec. 29, 2010

(87) PCT Pub. No.: WO2009/121350
PCT Pub. Date: Oct. 8, 2009

(65) Prior Publication Data

US 2011/0103931 A1 May 5, 2011

(30) Foreign Application Priority Data

Apr. 2, 2008 (DE) ..... 10 2008 016 800

(51) Int. Cl.
*F04D 27/02* (2006.01)

(52) U.S. Cl.
USPC ..... 415/1; 415/11; 415/58.5

(58) Field of Classification Search
USPC ..... 415/11, 26, 52.1, 58.4, 58.5, 58.7, 116, 415/117, 914
See application file for complete search history.

(56) References Cited

U.S. PATENT DOCUMENTS

| | | | | |
|---|---|---|---|---|
| 4,196,472 | A | 4/1980 | Ludwig et al. | |
| 5,275,528 | A | 1/1994 | Freeman et al. | |
| 5,340,271 | A * | 8/1994 | Freeman et al. | 415/1 |
| 6,055,805 | A * | 5/2000 | El-Aini et al. | 60/226.1 |
| 6,059,522 | A | 5/2000 | Gertz et al. | |
| 6,125,626 | A | 10/2000 | El-Aini et al. | |
| 6,517,309 | B1 * | 2/2003 | Zaher | 415/1 |

FOREIGN PATENT DOCUMENTS

| | | |
|---|---|---|
| DE | 10 2005 052 466 A1 | 5/2007 |
| EP | 1 406 018 A2 | 4/2004 |

OTHER PUBLICATIONS

PCT/DE2009/000461 PCT/ISA/210.

* cited by examiner

*Primary Examiner* — Edward Look
*Assistant Examiner* — Jason Davis
(74) *Attorney, Agent, or Firm* — Crowell & Moring LLP

(57) ABSTRACT

A gas turbine compressor is disclosed. The compressor includes a compressor housing, guide vanes, rotor blades, and valve-controlled blow-in openings for stabilizing the compressor flow by air that is blown in. The air flow is detected by pressure sensors and the valves are controlled as a function thereof.

13 Claims, 2 Drawing Sheets

GAS TURBINE COMPRESSOR

This application claims the priority of International Application No. PCT/DE2009/000461, filed Apr. 2, 2009, and German Patent Document No. 10 2008 016 800.9, filed Apr. 2, 2008, the disclosures of which are expressly incorporated by reference herein.

BACKGROUND AND SUMMARY OF THE INVENTION

The invention relates to a gas turbine compressor comprising a compressor housing, guide vanes, rotor blades, valve-controlled blow-in openings for stabilizing the compressor flow and at least one valve for controlling the quantity of air blown in via the blow-in openings.

Compressors may begin to pump under certain operating conditions (throttling). Typically, the pumping is produced from an unstable flow condition. This state can occur especially in a partial load range (off-design state). The gas turbine compressor is designed for specific flight conditions, in which it must generate the pre-calculated characteristic values such as throughput, compression ratio, efficiency, etc. But even beyond these design items, the compressor must possess still acceptable and safe operating behavior, for example, on the landing approach of an aircraft, where quick thrust changes and thus quick changes in speed are required for adhering to a glide path. But even when starting up in the lower speed range, the compressor must make sure that the flow is smooth and must enable rapid acceleration to full load.

Of course, the characteristic curve of a compressor is also measured in the partial load range. To determine a safe operating range, the so-called travel line must connect the operating points on the various speed lines to one another, possess an adequate safety margin from the so-called pumping limit, at which, as already stated, a flow separation occurs on the compressor blades.

There have already been attempts in the past to shift the pumping limit as far as possible towards low throughputs in order to be able to bring the travel line into other ranges or to establish a still greater distance from the pumping limit.

Solutions in the prior art are in particular blowing air into the housing or rotor region of a compressor under certain operating conditions. This lateral blowing of air in the direction of rotor blades is supposed to stabilize the flow in the compressor.

The blowing in of air can be stationary (without changing the mass flow of blown-in air) or be controlled with the aid of valves, wherein the latter is described in German Patent Document No. DE 10 2005 052 466 A1 and U.S. Pat. No. 6,125,626.

The object of the invention is improving the stabilization of the flow in the region of the rotor blades even further.

To this end, the inventive gas turbine compressor of the type mentioned at the outset provides that at least one pressure sensor coupled with the control mechanism of the valve be provided in the region of the rotor blades for detecting the pressure in the compressor, wherein the valve can be controlled as a function of the pressure detected.

Whereas the possible operating conditions in the compressor are computed via algorithms in the prior art, the invention provides for detecting the actual pressure via pressure sensors in the crucial regions, namely in the region of the rotor blades, and controlling the inflow of air so to speak as a function of the actual value in practice rather than the theoretical value.

Several pressure sensors distributed over the circumference of the flow channel (annular channel between the rotor and outer housing) are preferably provided. These pressure sensors are situated so to speak on a type of ring.

According to the preferred embodiment, several pressure sensors distributed over the circumference of the flow channel are even provided upstream and downstream from the blow-in openings so that the pressures before and after introducing the additional air may be detected, which is even more effective.

The blow-in openings should be arranged directly upstream from the rotor blades.

Because there are flow conditions in which modular circumferential disturbances occur during pumping, it is advantageous that every blow-in opening be assigned its own valve.

Of course, several blow-in openings may have one of numerous valves in order to save on components and costs.

Continuous, modulated or pulsed flows may be achieved using the numerous valves assigned to the blow-in openings.

Modular circumferential disturbances may be extinguished so to speak by targeted anti-phase blow-in such as with anti-noise. Of course, brief, peak-like disturbances may also be effectively corrected by a quick, complete opening of one or more valves.

The valve(s) are microvalves, in particular based on MEMS technology.

These types of valves are characterized by a rapid switchability and for the most part have an external actuator, which can allow the valve to also modulate/vibrate (e.g., at 400 Hz).

The control mechanism for the pressure sensors may be integrated into the respective pressure sensor itself so that a pressure sensor is assigned to one or more valves and controls these directly, or a central control mechanism may be provided.

The actuators are solenoids or piezo elements in particular.

The valves as well as the blow-in openings are situated in particular in the outer housing, wherein, however, an inflow in the hub region is also possible as an alternative.

Furthermore, the invention creates a method for stabilizing the gas turbine compressor flow by means of an electric control mechanism, which is coupled with several valves on inflow openings provided on the circumference of the flow channel. The method according to the invention provides that the pressure conditions in the flow channel are detected and the valves are controlled as a function thereof. Detection is accomplished directly via the pressure sensors.

The pressure conditions are detected in particular upstream and/or downstream from the inflow openings.

As already explained, the valves may be optionally opened continuously, in a modulated manner or in a pulsed manner; the control mechanism permits all these possibilities.

Additional features and advantages of the invention are disclosed in the following description and in the following drawings to which reference is made.

DETAILED DESCRIPTION OF THE DRAWINGS

Figure 1:
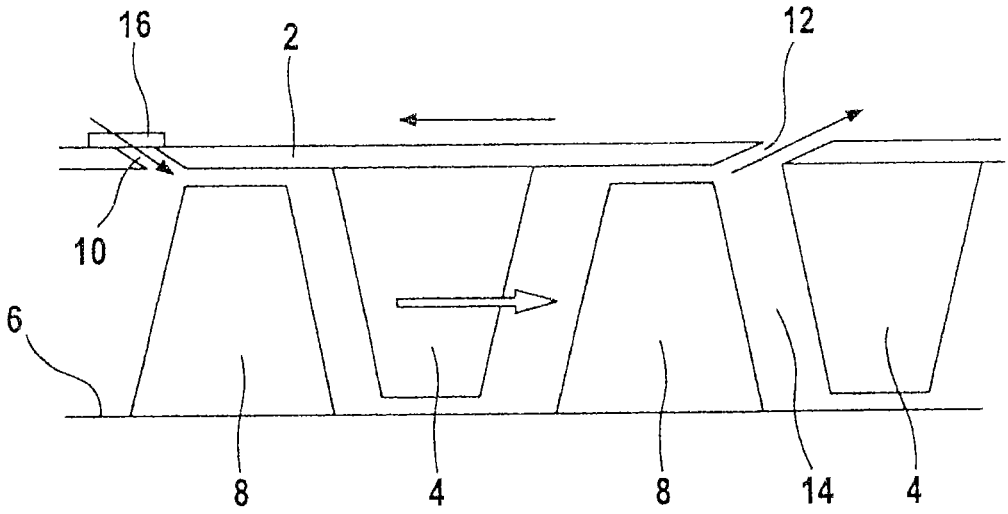
FIG. 1 is a longitudinal section through a gas turbine compressor according to the invention.

FIG. 1 depicts a multi-stage gas turbine compressor in an axial design. The gas turbine compressor has a ring-shaped compressor housing 2, guide vanes 4 arranged on the housing 2 and several rotor blades 8 arranged on a rotor 6. Directly upstream from the blade tip of a rotor blade ring, the housing 2 has numerous blow-in openings 10 distributed uniformly over the circumference. Downstream from this rotor blade ring 8, the housing 2 has outlet openings 12, via which the compressed air is discharged from the annular channel 14 and, as shown by the arrow, is guided to the blow-in openings 10.

The blown-in air for stabilizing the compressor flow is directed directly at the blade tip, as shown in FIG. 1.

Figure 2:
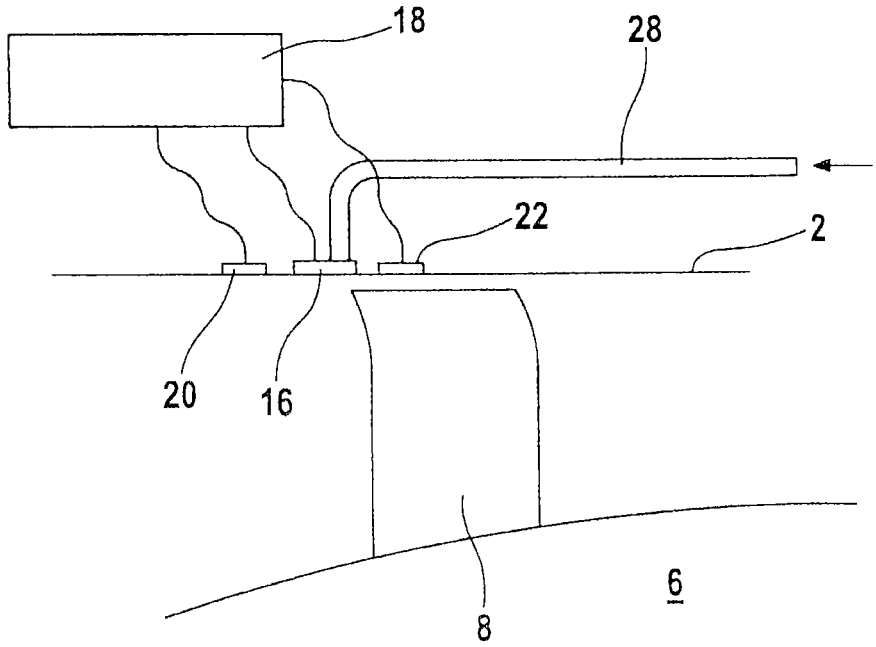
FIG. 2 is a detailed view of the compressor according to the invention in the region of a rotor blade, wherein the guide vanes are omitted to increase the clarity.
Figure 4:
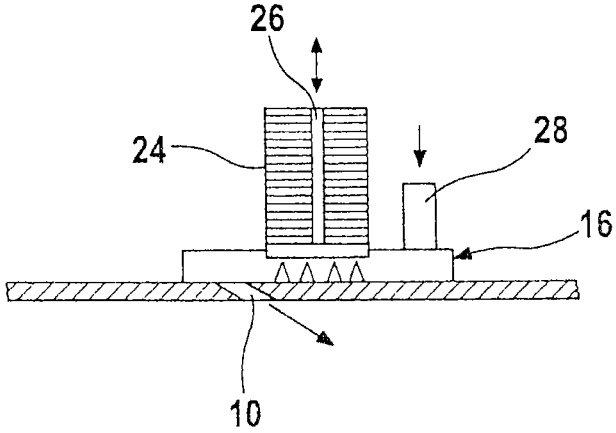
FIG. 4 is an enlarged view in the region of a microvalve, which is used with the compressor according to the invention.

The quantity of the blown-in air is controlled by valves 16, which are coupled with a control mechanism 18 (see FIG. 2). The valves 16 are so-called microvalves, which are depicted in FIG. 4. These microvalves have dimensions of just about an area of 10×15 mm and a thickness of approximately 1 mm and are especially well suited to be arranged in a space-saving manner on the outer housing 2.

Each blow-in opening 10 has its own valve 16 assigned to it.

Figure 3:
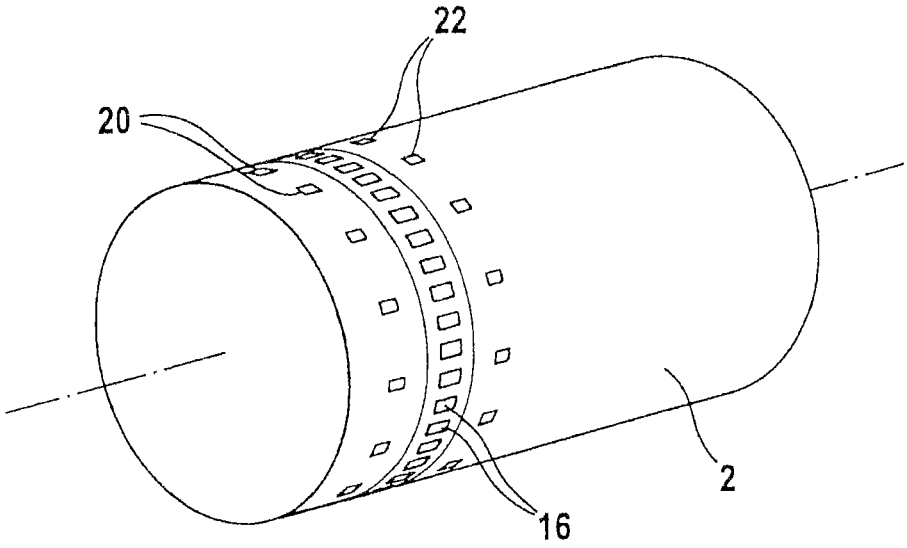
FIG. 3 is a perspective top view of a part of the compressor housing.

FIG. 3 shows that there is a sort of ring of valves 16, which run around the housing 2 and are fastened directly to the housing 2.

In order to detect critical flow conditions directly, pressure sensors 20, 22 are attached on the housing 2 upstream and/or downstream from the blow-in openings 10, which determine the pressure in front of, in the region of, or after the rotor blades 8 that are subject to the inflow (see FIG. 2).

Numerous pressure sensors 20, 22 are arranged distributed over the circumference, as shown in FIG. 3.

In the following, the microvalves will be discussed in more detail and a greatly enlarged representation of such a microvalve is depicted in FIG. 4.

An actuator is respectively coupled with each valve 16. The actuator may be for example a compact solenoid 24 including a ram 26 or a piezo actuator. FIG. 4 also shows the supply line 28 for the branched-off air.

All in all, a large number (400 to 800) of microvalves are fastened on the housing 2, and just as many blow-in openings 10 are provided. Of course, several rotor blade rings with their own ring of blow-in openings 10 may also be provided.

Depending upon what pressure conditions are currently being detected by the pressure sensors 20, 22, the control mechanism 18 closes all valves 16, or individual valves or all valves 16 are opened simultaneously or successively. Every valve 16 is controlled individually so that a synchronized control of all valves 16 is possible in order to generate any circumferential waveforms or circulating waves of blown-in air. These circumferential waves may equalize circumferential disturbances of the compressor flow, because the compressor may often show modal circumferential disturbances in specific operating states, which may be damped or completely extinguished by the targeted anti-phase blow-in.

Due to the targeted opening, closing or modulating, the inflowing quantity of air for generation of a stream is considerable reduced as compared with a stationary; continuous inflow of branched-off air.

The control mechanism 18 may also be integrated into the microvalves 16.

As soon as the critical operating range is left, the valves 16 are naturally closed again so as not to reduce efficiency unnecessarily.

The invention claimed is:

1. A gas turbine compressor, comprising:

a compressor housing with a guide vane, a rotor blade, and a blow-in opening;

a control mechanism and a valve associated with the blow-in opening, wherein the valve is a microvalve and wherein the microvalve is fastened directly to the compressor housing; and a pressure sensor coupled with the control mechanism of the valve, wherein the pressure sensor is provided in a region of the rotor blade for detecting a pressure in the compressor and wherein the valve is controllable as a function of a pressure detected by the pressure sensor.

2. The gas turbine compressor according to claim 1, wherein a plurality of pressure sensors are distributed over a circumference of a flow channel of the compressor.

3. The gas turbine compressor according to claim 1, wherein the pressure sensor is provided upstream and/or downstream from the blow-in opening.

4. The gas turbine compressor according to claim 1, wherein the blow-in opening is arranged directly upstream from the rotor blade.

5. The gas turbine compressor according to claim 1, wherein the valve is only associated with the blow-in opening.

6. The gas turbine compressor according to claim 1, further comprising a second pressure sensor coupled with the control mechanism of the valve, wherein the pressure sensor is provided in the region of the rotor blade adjacent to an upstream side of the blow-in opening, wherein the second pressure sensor is provided in the region of the rotor blade adjacent to a downstream side of the blow-in opening, and wherein the valve is controllable as a function of a respective pressure detected by the pressure sensor and the second pressure sensor.

7. The gas turbine compressor according to claim 1, wherein the microvalve is fastened directly to the compressor housing over the blow-in opening and wherein the microvalve is coupled to a solenoid including a ram.

8. A method for stabilizing a gas turbine compressor flow by an electric control mechanism which is coupled with a valve on an inflow opening arranged on a circumference of a flow channel, comprising the steps of:

detecting a pressure condition in the flow channel; and controlling the valve as a function of the step of detecting the pressure, wherein the valve is a microvalve and wherein the microvalve is fastened directly to a compressor housing that defines the flow channel.

9. The method according to claim 8, wherein the pressure condition is detected upstream and/or downstream from the inflow opening.

10. The method according to claim 8, wherein the valve is controllable such that the valve is opened continuously, opened in a modulated manner, or is opened in a pulsed manner.

11. The method according to claim 8, wherein the step of controlling the valve generates a circumferentially variable pressure and/or velocity field which is set into rotation relative to the compressor housing.

12. The method according to claim 8, wherein the pressure condition is detected by a first pressure sensor provided in a region of a rotor blade adjacent to an upstream side of the inflow opening and a second pressure sensor provided in the region of the rotor blade adjacent to a downstream side of the inflow opening.

13. The method according to claim 8, wherein the microvalve is fastened directly to the compressor housing over the inflow opening and wherein the microvalve is coupled to a solenoid including a ram.

* * * * *